US007390354B2

(12) United States Patent
Aiba et al.

(10) Patent No.: US 7,390,354 B2
(45) Date of Patent: Jun. 24, 2008

(54) ELECTROLESS GOLD PLATING SOLUTION

(75) Inventors: Akihiro Aiba, Kitaibaraki (JP); Kazumi Kawamura, Kitaibaraki (JP)

(73) Assignee: Nikko Materials Co., Ltd., Tokyo (JP)

( * ) Notice: Subject to any disclaimer, the term of this patent is extended or adjusted under 35 U.S.C. 154(b) by 0 days.

(21) Appl. No.: 10/570,394

(22) PCT Filed: Jun. 23, 2005

(86) PCT No.: PCT/JP2005/011545

§ 371 (c)(1),
(2), (4) Date: Mar. 2, 2006

(87) PCT Pub. No.: WO2006/006367

PCT Pub. Date: Jan. 19, 2006

(65) Prior Publication Data

US 2006/0269761 A1 Nov. 30, 2006

(30) Foreign Application Priority Data

Jul. 9, 2004 (JP) ..... 2004-203044
Nov. 12, 2004 (JP) ..... 2004-328671

(51) Int. Cl.
*C23C 18/31* (2006.01)

(52) U.S. Cl. ..... 106/1.23; 106/1.26

(58) Field of Classification Search ..... 106/1.23, 106/1.26; 428/457
See application file for complete search history.

(56) References Cited

U.S. PATENT DOCUMENTS 5,232,492 A * 8/1993 Krulik et al. ..... 106/1.23
5,318,621 A * 6/1994 Krulik et al. ..... 106/1.23
5,470,381 A * 11/1995 Kato et al. ..... 106/1.23
5,935,306 A * 8/1999 Reed ..... 106/1.23
6,776,828 B2 * 8/2004 Kanzler et al. ..... 106/1.23
2006/0230979 A1 * 10/2006 Aiba et al. ..... 106/1.23

FOREIGN PATENT DOCUMENTS

| | | |
|---|---|---|
| JP | 4314870 | 11/1992 |
| JP | 8291389 | 11/1996 |
| JP | 10317157 | 12/1998 |
| JP | 2002-273239 | 9/2002 |
| JP | 2003-013249 | 1/2003 |
| JP | 2004-323872 | 11/2004 |
| WO | WO 2004/108987 | 12/2004 |

OTHER PUBLICATIONS

Derwent abstract of JP2004/323872, Nov. 2004.*

* cited by examiner

*Primary Examiner*—Helene Klemanski
(74) *Attorney, Agent, or Firm*—Flynn, Thiel, Boutell & Tanis, P.C.

(57) ABSTRACT

A cyanide-free immersion type electroless gold plating solution that is less toxic can be used at near neutrality and gives an excellent and improved solder adhesion and plated film adhesion is provided.

The electroless gold plating solution contains a cyanide-free water-soluble gold compound, a pyrosulfurous acid compound and a thiosulfuric acid compound. This plating solution preferably further contains a sulfurous acid compound and an aminocarboxylic acid compound. Pyrosulfurous acid and alkali metal salts, alkaline-earth metal salts, ammonium salts and other salts thereof can be used as the pyrosulfurous acid compound.

3 Claims, No Drawings

ELECTROLESS GOLD PLATING SOLUTION

TECHNICAL FIELD

This invention relates to plating technology, and more particularly relates to a cyanide-free immersion type electroless gold plating solution.

BACKGROUND ART

Immersion type electroless gold plating solutions are used for intermediate layers for the purpose of improving the solder adhesion of circuits, terminals, and so forth of printed wiring boards and improving the adhesion of reductive gold plating and the like. Most of the gold plating solutions employed for this purpose involve a toxic cyanide compound as the gold compound, but for environmental and workplace concerns, a cyanide-free gold plating solution that does not employ toxic substances have been required.

Patent applications that have been filed for cyanide-free immersion type electroless gold plating solutions include those that make use of gold sulfite compounds (see, for example, Patent Document 1 and Patent Document 2), those that make use of a salt of gold sulfites or chloroaurates (see, for example, Patent Document 3), and those that make use of gold sulfite, gold chloride, gold thiosulfate, or gold mercaptocarboxylates (see, for example, Patent Document 4). The electroless gold plating solutions described therein are cyanide free and therefore less toxic, and can be used at near neutrality, but they still have the problems of inferior solder adhesion and plating film adhesion. "Plating film adhesion" refers to the adhesion between a immersion type electroless gold plating film and the substrate and, when a immersion type electroless gold plating film is used as an intermediate layer, that refers to the adhesion between the layers above and below the film.

Patent Document 1: Japanese Patent No. 3,030,113

Patent Document 2: Japanese Patent Publication No. 2003-13249

Patent Document 3: Japanese Patent Publication No. H8-291389

Patent Document 4: Japanese Patent Publication No. H10-317157

DISCLOSURE OF THE INVENTION

Problem to be Solved by the Invention

In view of the foregoing situation, it is an object of this invention to provide a cyanide-free immersion type electroless gold plating solution that exhibits low toxicity, good solder adhesion and good plating film adhesion and that can be used at around neutrality.

MEANS FOR SOLVING THE PROBLEMS

As a result of investigation for the factors that impairs the solder adhesion and plating film adhesion of immersion type electroless gold plating film, the inventors revealed that the problem is non-uniform substitution from the underlying metal film, such as an underlying nickel film. More specifically, when non-uniform corrosion marks such as pitting were seen in the underlying nickel film after the gold plating film had been stripped off, the solder adhesion and plating film adhesion were poor because defects of some kind were also present in the immersion type electroless gold plating film.

Conversely, the solder adhesion and plating film adhesion were good when non-uniform corrosion marks were not present.

As a result of investigations into a bath composition that would eliminate the non-uniform corrosion marks in the underlying nickel film after the gold is stripped off, the inventors have already discovered that the addition of a pyrosulfurous acid compound to a cyanide-free water-soluble gold compound is effective as a cyanide-free immersion type electroless gold plating solution, thereby, that liquid affords gold plating films that exhibit an excellent solder adhesion and plating film adhesion (see PCT/JP2004/001784). This plating solution improves solder adhesion and plating film adhesion in comparison to conventional cyanide-free immersion type electroless gold plating solutions and also provides an excellent adhesive strength with lead-free solder and the like. However, as a result of further investigations into cyanide-free immersion type electroless gold plating that would have an even better solder adhesion and plating film adhesion, the inventors found out that, by the addition of a thiosulfuric acid compound along with the pyrosulfurous acid compound as additives for the plating solution, the solder adhesive strength is additionally enhanced and the reliability is improved. This invention was achieved based on this discovery.

More specifically, the present invention is as follows.

(1) An immersion type electroless gold plating solution, comprising a cyanide-free water-soluble gold compound, a pyrosulfurous acid compound and a thiosulfuric acid compound.

(2) An immersion type electroless gold plating solution according to (1), further containing a sulfurous acid compound.

(3) An immersion type electroless gold plating solution according to (1) or (2), further containing an aminocarboxylic acid compound.

(4) A gold plated article, produced by the use of an immersion type electroless gold plating solution according to any of (1) to (3).

The cyanide-free water-soluble gold compound used in the plating solution according to the present invention is not particularly restricted as long as it is free from cyanide and water soluble, while the plating solution is characterized by containing a pyrosulfurous acid compound and a thiosulfuric acid compound as additives.

EFFECT OF THE INVENTION

The present invention provides a cyanide-free immersion type electroless gold plating solution that has a low toxicity, that can be used at near neutrality, and that exhibits an even better solder adhesion and plated film adhesion. The present invention in particular provides a cyanide-free immersion type electroless gold plating solution that improves the adhesive strength with lead-free solder, which showed low adhesive strength.

BEST MODE FOR CARRYING OUT THE INVENTION

The immersion type electroless gold plating solution according to the present invention is explained in detail hereinbelow.

The electroless gold plating solution according to the present invention is prepared by dissolving a cyanide-free water-soluble gold compound, a pyrosulfurous acid compound, and a thiosulfuric acid compound in water.

The cyanide-free water-soluble gold compound should be a cyanide-free gold compound but is not otherwise particularly restricted. As the compound, gold sulfite, gold thiosulfate, gold thiocyanate, chloroauric acid, or a salt of the preceding is preferably used. Usable as the salt are alkali metal salts, alkaline-earth metal salts, ammonium salt and so forth, and sodium salt, potassium salt, ammonium salt and so forth are preferred. The electroless gold plating solution according to the present invention contains these gold compounds preferably at 0.1 to 100 g/L and more preferably 0.5 to 20 g/L as the gold concentration in the plating solution. The gold substitution rate slows substantially at a gold concentration less than 0.1 g/L, while values above 100 g/L are meritless with no further improvement.

Usable as the pyrosulfurous acid compound are pyrosulfurous acid and its alkali metal salts, alkaline-earth metal salts, ammonium salt and so forth, and preferably sodium pyrosulfite, potassium pyrosulfite, ammonium pyrosulfite and so forth are used. The plating solution contains preferably 0.1 to 200 g/L of the pyrosulfurous acid compound and more preferably 1 to 100 g/L. The effect to prevent non-uniform corrosion of the underlying nickel is weak when the pyrosulfurous acid compound concentration is less than 0.1 g/L, while values in excess of 200 g/L brings no further advantage.

Usable as the thiosulfuric compound are the alkali metal salts, alkaline-earth metal salts, ammonium salt, and so forth of thiosulfuric acid, and preferably sodium thiosulfate, potassium thiosulfate, ammonium thiosulfate and so forth are employed. The plating solution includes preferably 1 mg/L to 10 g/L of the thiosulfuric acid compound and more preferably 10 to 1000 mg/L. There is little improvement in the solder adhesive strength when the thiosulfuric acid compound concentration is less than 1 mg/L, while values above 10 g/L brings no further merit.

The electroless gold plating solution according to the present invention also preferably includes a sulfurous acid compound as a stabilizer. As the sulfurous acid compound, sulfurous acid and its alkali metal salts, alkaline-earth metal salts, ammonium salt and so forth are exemplified. The concentration of the sulfurous acid compound in the plating solution is preferably 0.1 to 200 g/L and more preferably is 1 to 100 g/L. The activity as a stabilizer does not appear at less than 0.1 g/L, while values over 200 g/L are meritless with no further improvement.

The gold plating solution of the present invention may also contain an aminocarboxylic acid compound as a complexing agent. Examples of the aminocarboxylic acid compound includes ethylenediaminetetraacetic acid, hydroxyethylethylenediaminetriacetic acid, dihydroxyethylethylenediaminediacetic acid, propanediaminetetraacetic acid, diethylenetriaminepentaacetic acid, triethylenetetraminehexaacetic acid, glycine, glycylglycine, glycylglycylglycine, dihydroxyethylglycine, iminodiacetic acid, hydroxyethyliminodiacetic acid, nitrilotriacetic acid, and nitrilotripropionic acid, and the alkali metal salts, alkaline-earth metal salts, ammonium salts and so forth of the preceding. The concentration of the aminocarboxylic acid compound in the plating solution is preferably 0.1 to 200 g/L and more preferably 1 to 100 g/L. The effect as a complexing agent is poor when the concentration of the aminocarboxylic acid compound is less than 0.1 g/L, while values in excess of 200 g/L provides no further advantage.

A phosphoric acid compound may also be added as a pH buffer to the electroless gold plating solution according to the present invention, as necessary.

As the phosphoric acid compound, phosphoric acid and pyrophosphoric acid and alkali metal salts alkaline-earth metal salts and ammonium salts thereof, and alkali metal dihydrogenphosphates, alkaline-earth metal dihydrogenphosphates, ammonium dihydrogenphosphate, dialkali metal hydrogenphosphates, alkaline-earth metal hydrogenphosphates, diammonium hydrogenphosphate and so forth are exemplified. The concentration of the phosphoric acid compound in the plating solution is preferably 0.1 to 200 g/L and more preferably 1 to 100 g/L.

The pH of the gold plating solution according to the present invention is adjusted using the aforementioned compounds as pH buffers preferably to pH 4 to 10 and more preferably to pH 5 to 9.

The gold plating solution of the present invention is preferably used at a bath temperature of 10 to 95° C. and more preferably 50 to 85° C.

Problems such as a slow plating rate and facile bath decomposition can occur when the pH and bath temperature of the plating solution are outside of the ranges given above.

A plating film which was plated by use of the gold plating solution of the present invention after an underlying nickel plating has been plated on a printed wiring board exhibits an excellent solder adhesion and plated film adhesion due to the absence of non-uniform substitution from the underlying nickel plating film. Non-uniform corrosion marks are not seen in the underlying nickel film after the gold plating film is stripped off.

EXAMPLES

Preferred embodiments of this invention are described by the examples and comparative examples provided below.

Examples 1 and 2

Plating solutions with the compositions given in Table 1 were prepared as the immersion type electroless gold plating solution. A copper-clad printed wiring board with 0.4 mm-diameter resist openings was used as a material to be plated and it was plated by the following process.

acid degreasing (45° C., 5 minutes)
→ soft etching (25° C., 2 minutes)
→ acid rinse (25° C., 1 minute)
→ activator (KG-522 made by Nikko Metal Plating) (25° C., pH<1.0, 5 minutes)
→ acid rinse (25° C., 1 minute)
→ electroless nickel-phosphorus plating
(plating solution: KG-530 made by Nikko Metal Plating,
grade: the phosphorous concentration in the plated film was approximately 7%)
(88° C., pH 4.5, 30 minutes)
→ immersion type electroless gold plating (plating solution and plating conditions given in Table 1)
→ reductive electroless gold plating
(plating solution: KG-560 made by Nikko Metal Plating)
(70° C., pH 5.0, 30 minutes)
(a one-minute water rinse step is inserted between all steps except acid rinse → activator)

The plated articles thus obtained were evaluated as follows.

For the state of corrosion of the underlying nickel plating film, the presence/absence of pitting corrosion marks was visually checked by SEM at 2000× magnification after the immersion type electroless gold plating film had been stripped off using Aurum Stripper 710 (25° C., 0.5 minute), a gold stripper made by Nikko Metal Plating.

For the solder adhesive strength, a 0.4 mm-diameter Sn-37Pb solder ball was mounted after the immersion type electroless gold plating procedure had been carried out, and the ball was adhered by heating at a peak temperature of 240° C. in a reflow oven. The solder adhesive strength was then measured by the hot bump pull method using a series 4000 bond tester made by Dage.

For the plated film adhesion, reductive electroless gold plating was performed after the immersion type electroless gold plating, and the presence/absence of plated film peeling was then visually scored after a tape peel testing. The peel test is a test in which cellophane tape (Cellotape® made by Nichiban) is adhered to the plated film; the tape is then peeled off; and the presence/absence of adhesion by the plated film to the tape is visually checked.

The thickness of the plated film was measured using an SFT-3200 fluorescent x-ray coating thickness gauge made by Seiko Denshi Kogyo.

The results of the evaluations are given in Table 1.

Examples 3 and 4 and Comparative Examples 1 and 2

Plating solutions with the compositions given in Table 1 were prepared as the immersion type electroless gold plating solution, and plated articles were fabricated by the same plating process as Example 1.

The solder adhesive strength was measured in the same way as Example 1, but in this case using a 0.4 mm-diameter Sn-3.0Ag-0.5Cu lead-free solder ball and bonding by heating at a peak temperature of 250° C. in the reflow oven. The results of the evaluations are given in Table 1.

Examples 5 and 6

Plated articles were fabricated by the same plating procedure as in Example 1, except for the conditions of the electroless nickel-phosphorus plating and the immersion type electroless gold plating, i.e., the latter immersion type electroless gold plating condition was given in Table 1 and the former was the following:

plating solution: KG-571 made by Nikko Metal Plating, grade: the phosphorous concentration in the plated film is approximately 9%; and plating conditions: 80° C., pH 4.6, 30 minutes.

The solder adhesive strength was measured in the same manner as Example 1, but in this case using a 0.4 mm-diameter Sn-3.0Ag-0.5Cu lead-free solder ball and adhering by heat at a peak temperature of 250° C. in the reflow oven. The results of the evaluations are given in Table 1.

Examples 7 to 10

Plated articles were fabricated by plating in the same procedure as Example 3 except for the plating solutions with the compositions given in Table 1, which were used instead of the immersion type electroless gold plating solution used in Example 3. The articles were also evaluated in the same way as Example 3, and the results of the evaluations are given in Table 1.

TABLE 1

| | | Examples | | | |
|---|---|---|---|---|---|
| | | 1 | 2 | 3 | 4 |
| Bath composition | Gold compound | Sodium gold sulfite: 1 g/L (gold) | Sodium chloroaurate: 1 g/L (gold) | Sodium gold sulfite: 1 g/L (gold) | Sodium chloroaurate: 1 g/L (gold) |
| | Additive | Sodium pyrosulfite: 5 g/L | Sodium pyrosulfite: 10 g/L | Sodium pyrosulfite: 5 g/L | Sodium pyrosulfite: 10 g/L |
| | Additive | Sodium thiosulfate: 50 mg/L | Sodium thiosulfate: 100 mg/L | Sodium thiosulfate: 50 mg/L | Sodium thiosulfate: 100 mg/L |
| | Stabilizer | Sodium sulfite: 5 g/L | Sodium sulfite: 10 g/L | Sodium sulfite: 5 g/L | Sodium sulfite: 10 g/L |
| | Complexing agent | Ethylenediamine-tetraacetic acid: 10 g/L | Nitrilotriacetic acid: 10 g/L | Ethylenediamine-tetraacetic acid: 10 g/L | Nitrilotriacetic acid: 10 g/L |
| | pH buffer | Sodium dihydrogen-phosphate: 30 g/L | Disodium hydrogen-phosphate: 30 g/L | Sodium dihydrogen-phosphate: 30 g/L | Disodium hydrogen-phosphate: 30 g/L |
| Plating conditions | pH | 7.5 | 7.5 | 7.5 | 7.5 |
| | Treatment temp. (° C.) | 80 | 80 | 80 | 80 |
| | Treatment time (min) | 20 | 20 | 20 | 20 |
| Evaluation results | Film thickness (μm) | 0.05 | 0.05 | 0.05 | 0.05 |
| | Pitting | no | no | no | no |
| | Solder adh. strength | 1641 | 1610 | 1423 | 1402 |
| | Plated film adhesion | no peeling | no peeling | no peeling | no peeling |

| | | Comparative Examples | | Examples | |
|---|---|---|---|---|---|
| | | 1 | 2 | 5 | 6 |
| Bath composition | Gold compound | Sodium gold sulfite: 1 g/L (gold) | Sodium chloroaurate: 1 g/L (gold) | Sodium gold sulfite: 1 g/L (gold) | Sodium chloroaurate: 1 g/L (gold) |
| | Additive | Sodium pyrosulfite: 5 g/L | Sodium pyrosulfite: 10 g/L | Sodium pyrosulfite: 5 g/L | Sodium pyrosulfite: 10 g/L |

TABLE 1-continued

| | | | | | |
|---|---|---|---|---|---|
| | Additive | — | — | Sodium thiosulfate: 50 mg/L | Sodium thiosulfate: 100 mg/L |
| | Stabilizer | Sodium sulfite: 5 g/L | Sodium sulfite: 10 g/L | Sodium sulfite: 5 g/L | Sodium sulfite: 10 g/L |
| | Complexing agent | Ethylenediamine-tetraacetic acid: 10 g/L | Nitrilotriacetic acid: 10 g/L | Ethylenediamine-tetraacetic acid: 10 g/L | Nitrilotriacetic acid: 10 g/L |
| | pH buffer | Sodium dihydrogen-phosphate: 30 g/L | disodium hydrogen-phosphate: 30 g/L | Sodium dihydrogen-phosphate: 30 g/L | disodium hydrogen-phosphate: 30 g/L |
| Plating conditions | pH | 7.5 | 7.5 | 7.5 | 7.5 |
| | Treatment temp. (° C.) | 80 | 80 | 80 | 80 |
| | Treatment time (min) | 20 | 20 | 20 | 20 |
| Evaluation results | Film thickness (μm) | 0.05 | 0.05 | 0.05 | 0.05 |
| | Pitting | no | no | no | no |
| | Solder adh. strength | 1216 | 1195 | 1587 | 1536 |
| | Plated film adhesion | no peeling | no peeling | no peeling | no peeling |

| | | Examples | | | |
|---|---|---|---|---|---|
| | | 7 | 8 | 9 | 10 |
| Bath composition | Gold compound | Sodium gold sulfite: 1 g/L (gold) | Sodium chloroaurate: 1 g/L (gold) | Sodium gold sulfite: 1 g/L (gold) | Sodium chloroaurate: 1 g/L (gold) |
| | Additive | Sodium pyrosulfite: 1 g/L | Sodium pyrosulfite: 2 g/L | Sodium pyrosulfite: 50 g/L | Sodium pyrosulfite: 100 g/L |
| | Additive | Sodium thiosulfate: 10 mg/L | Sodium thiosulfate: 100 mg/L | Sodium thiosulfate: 50 mg/L | Sodium thiosulfate: 75 mg/L |
| | Stabilizer | Sodium sulfite: 10 g/L | Sodium sulfite: 15 g/L | Sodium sulfite: 10 g/L | Sodium sulfite: 15 g/L |
| | Complexing agent | Ethylenediamine-tetraacetic acid: 5 g/L | Nitrilotriacetic acid: 10 g/L | Ethylenediamine-tetraacetic acid: 10 g/L | Nitrilotriacetic acid: 20 g/L |
| | pH buffer | Trisodium phosphate: 30 g/L | Disodium hydrogen-phosphate: 20 g/L | Sodium dihydrogen-phosphate: 30 g/L | Potassium pyrophosphate: 40 g/L |
| Plating conditions | pH | 7.5 | 7.5 | 7.5 | 7.5 |
| | Treatment temp. (° C.) | 80 | 80 | 80 | 80 |
| | Treatment time (min) | 20 | 20 | 20 | 20 |
| Evaluation results | Film thickness (μm) | 0.05 | 0.05 | 0.05 | 0.05 |
| | Pitting | no | no | no | no |
| | Solder adh. strength | 1421 | 1438 | 1467 | 1455 |
| | Plated film adhesion | no peeling | no peeling | no peeling | no peeling |

Unit for the solder adhesive strength: gf (n = 20)

The results in Table 1 demonstrate that the gold plating solutions used in the comparative examples, which are electroless gold plating solutions described in PCT/JP2004/001784, provide plated articles that are free of pitting and that therefore exhibit an excellent solder adhesion and plated film adhesion. However, the results in Table 1 also demonstrate that the electroless gold plating solutions of the present invention bring solder adhesion much more improved than the gold plating solutions in the comparative examples.

The invention claimed is:

1. A substitutional electroless gold plating solution, consisting essentially of a cyanide-free water-soluble gold compound, a pyrosulfurous acid compound and a thiosulfuric acid compound selected from the group consisting of an alkali metal salt of thiosulfuric acid, an alkaline earth metal salt of thiosulfuric acid and an ammonium salt of thiosulfuric acid, wherein the concentration of the thiosulfuric acid compound is from 1-1000 mg/l.

2. A substitutional electroless gold plating solution according to claim 1, further containing a sulfurous acid compound.

3. A substitutional electroless gold plating solution according to claim 1, further containing an aminocarboxylic acid compound.

* * * * *